US005712067A

United States Patent [19]

Kawata

[11] Patent Number: 5,712,067

[45] Date of Patent: Jan. 27, 1998

[54] CYLINDRICAL SUBSTRATE FOR AN ORGANIC PHOTOCONDUCTOR FOR ELECTROPHOTOGRAPHY AND METHOD OF MANUFACTURE FOR THE SAME

[75] Inventor: Noriaki Kawata, Saitama, Japan

[73] Assignee: Fuji Electric Co., Ltd., Kawasaki, Japan

[21] Appl. No.: 658,227

[22] Filed: Jun. 4, 1996

[30] Foreign Application Priority Data

Jun. 2, 1995 [JP] Japan ..... 7-135512

[51] Int. Cl.[6] ..... G03G 5/10

[52] U.S. Cl. ..... 430/59; 430/62

[58] Field of Search ..... 430/62, 59; 524/401

[56] References Cited

U.S. PATENT DOCUMENTS 4,975,350 12/1990 Fujimaki et al. ..... 430/59

5,028,462 7/1991 Matlack et al. ..... 428/35.7

5,110,700 5/1992 Teuscher et al. ..... 430/64

5,585,429 12/1996 Reichmann ..... 524/401

*Primary Examiner*—John Goodrow

*Attorney, Agent, or Firm*—Morrison Law Firm

[57] ABSTRACT

The photoconductor of the invention includes a cylindrical substrate, and an organic photoconductive layer formed on the cylindrical substrate. The substrate is made of the material which contains polyphthalamide resin to which carbon black is added to lower the volume resistivity of the material to $10^4$ Ω cm or less. Reinforcing agent such as glass fibers may also be added to add dimensional and mechanical strength and stability. The photoconductive layer has a charge generating layer composed of a hydrozone compound.

94 Claims, 3 Drawing Sheets

CYLINDRICAL SUBSTRATE FOR AN ORGANIC PHOTOCONDUCTOR FOR ELECTROPHOTOGRAPHY AND METHOD OF MANUFACTURE FOR THE SAME

The present invention relates to a organic photoconductors for electrophotography. More specifically, the present invention relates to material and manufacture of conductive substrates for organic photoconductors for electrophotography.

BACKGROUND OF THE INVENTION

The interaction of electromagnetic radiation in the form of waves or particles of energy called photons with various materials can be utilized in a large number of applications. A review of basic principals of photon interaction with materials is found in Donald R. Askeland The Science and Engineering of Materials, Third Edition, PWS Publishing Company, Boston, Chapter 20, pages 670–700, which is incorporated herein by reference.

Electrophotography utilizes materials which show a change in electrical conductivity during light exposure. The basis for utilizing the principal of electrophotography in printing apparatus and copy machines is reviewed in Richard C. Doff, editor-in-chief, The Electrical Engineering Handbook, CRC Press, Ann Arbor, Mich., Chapter 83.2, pages 1958–1964, which is incorporated herein by reference.

Photoconductors, used in electrophotographic apparatus such as copying machines or printers which employ the electrophotographic technique, include a conductive substrate and a photoconductive layer laminated on the conductive substrate. Usually, due to design advantages, the conductive substrate of an electrophotographic apparatus is formed as a cylindrical tube, having a cylindrical peripheral surface on which the photoconductive layer is coated.

Aluminum or aluminum alloys, which are lightweight and exhibit excellent machinability, have been widely used as the material of the substrate. However, the peripheral surface of each cylindrical aluminum or aluminum alloy substrate must be manufactured under very low tolerances to exact specified dimensional precision (circularity of ±50 μm and precision of diameter of ±40 μm) and preferable surface roughness (Rmax of from 0.5 to 1.2 μm). Additionally, it is necessary to form spigot joints to which flanges are inserted on both end portions of each cylindrical substrate. It is also necessary to take countermeasures against surface alteration such as formation of anodic-oxidized film, since the surface of the aluminum or aluminum alloy substrate is chemically altered and deformed by moisture or oxygen when exposed to air. These combined disadvantages necessitate complex countermeasures leading to many steps and high costs of manufacture for the aluminum or aluminum alloy substrate.

Alternatively, as described in Japanese Examined Patent Application No. H02-17026 which is incorporated herein by reference, a dimensionally acceptable substrate can be fabricated by injection molding material containing polyphenylene sulfide resin (hereinafter referred to as "PPS resin") as the main component. Additionally, PPS resin is light in weight, highly resistant chemically and thermally, and the surface is not altered by oxidation when exposed to air. However, PPS resin substrates have drawbacks.

One of the requirements for the substrate is that it be electrically conductive. The level of conductivity is measured in terms of resistance. To obtain excellent imaging or printing quality, the volume resistivity of the substrate should be $10^4$ Ω cm or less. When the volume resistivity of the substrate exceeds $10^5$ Ω cm, the electric charge transfer from the substrate upon exposure to light is hindered, discharging is hindered, and the residual potential is raised.

Since the volume resistivity of PPS resin is comparatively very high (usually from $10^{15}$ to $10^{18}$ Ω cm), it cannot be used as a conductive substrate without modification to obtain high quality images or prints. Consequently, carbon black is added to provide the PPS resin with sufficient electrical conductivity. The volume resistivity for furnace carbon, usually referred to as "conductive carbon black" is from 1 to 10 Ω cm.

More than 20–25 weight % of conductive carbon black is required to be added to PPS resin in order to lower the resistivity of the PPS substrate below the $10^4$ Ω cm level. However, the addition of this much carbon black causes the viscosity of the PPS resin to increase, resulting in an increasing difficulty to injection mold with increasing carbon black content. Additionally, the mechanical strength of the substrate decreases with increasing carbon content.

These resulting problems are even more pronounced when the substrate formed from this resin is small in diameter (about 30 mm), has a thin wall thickness (about 3 mm), and/or is long (several hundreds mm). As the thickness of the substrate becomes thinner and its length becomes longer, it becomes further difficult to attain the specified dimensional precision.

Additionally, as the substrate becomes thinner and longer, slight deformation caused by the solvent of the coating liquid or by heating makes it difficult to obtain the desired dimensional precision. Also, the adhesiveness of the PPS resin, which is highly resistant to chemical reagent modification, to an organic photoconductive layer is unacceptable with pealing and separation of the organic photoconductive layer from the PPS substrate being common defects showing up during practical use of the photoconductor.

Usually, separate flanges are inserted into the substrate to ease fabrication and provide self-lubrication and low noise during use. Additional problems occur when both the flanges and the substrate are made of the PPS resin, or the substrate and the flanges are integrated into one unit. This is often done to attain sufficient precision of rotation and for decreasing the manufacturing steps. However, the PPS resin flange exhibits insufficient mechanical strength and wear resistance against friction. Thus, the integrated PPS resin flange/substrate configuration has problems holding up under ordinary use conditions.

OBJECTS AND SUMMARY OF THE INVENTION

It is an object of the invention to provide a cylindrical tubular substrate for electrophotography which is light in weight, easily manufacturable to precise dimensional parameters, chemically resistant especially to reaction with air and solvents, and showing improved dimensional stability so as not to be deformed thermally or chemically even when the substrate is thin and long.

It is another object of the invention to provide a cylindrical tubular substrate for electrophotography which has an appropriate surface roughness.

It is still another object of the invention to provide a cylindrical tubular substrate for electrophotography which exhibits a level of mechanically strength that renders it resistant to deformation even when the substrate is thin and long.

It is a further object of the invention to provide a photoconductor for electrophotography which facilitates uniformly forming an organic photoconductive layer tightly bonded directly to the substrate surface.

Accordingly, an aspect of the invention provides a cylindrical substrate for electrophotography which contains polyphthalamide resin as its main component.

According to another aspect of the invention, there is provided a cylindrical tubular substrate for electrophotography which contains polyphthalamide resin as its main component wherein carbon black or other conduction enhancing substance is added to the polyphthalamide resin to lower the substrate's volume resistivity to a level effective for use in electrophotography.

According to another aspect of the invention, the polyphthalamide resin used for the cylindrical tubular substrate is an aromatic polyamide resin. For example a preferred resin is a polyamide resin synthesized by polymerizing terephthalic acid and diamine. This polyamide resin exhibits higher thermal resistance than that of the conventional polyamide resin. It also exhibits less dimensional change due to moisture absorption, since the terephthalic acid/diamine type polyphthalamide resin is less hygroscopic due to reduced polyamide bonding concentration in the molecule.

According to another aspect of the invention, a favorable surface roughness is obtained by confining the average grain diameter of the carbon black within the range of from 20 to 50 nm. In association with the carbon addition, an optional dispersing agent is preferably added to uniformly distribute the carbon black in the substrate material. Magnesium sulfide, talc, potassium titanate, potassium silicate, potassium carbonate, and clay are examples of dispersing agents that may be used for this purpose.

According to another aspect of the invention, the mechanical strength of the substrate is improved by adding a reinforcing agent. Glass fiber is an example of an acceptable reinforcing agent. However, carbon (graphite), Kevlar™ and other numerous fibrous fillers known to reinforce and add other advantages to resins may be appropriately substituted.

Another aspect of the invention is that since the polyphthalamide resin of the invention is highly compatible with organic materials, the organic photoconductive layer may be tightly fixed onto the substrate simply by washing to degrease the substrate surface prior to applying the photoconductive layer.

Briefly stated, the photoconductor of the invention includes a cylindrical substrate, and an organic photoconductive layer formed on the cylindrical substrate. The substrate is made of the material which contains polyphthalamide resin to which carbon black is added to lower the volume resistivity of the material to $10^4$ Ω cm or less. Reinforcing agent such as glass fibers may also be added to add dimensional and mechanical strength and stability.

There is provided in this invention for a cylindrical tubular substrate for electrophotography comprising; polyphthalamide resin as the main component thereof.

There is provided in this invention for a cylindrical tubular substrate for electrophotography comprising; polyphthalamide resin as the main component thereof, and carbon black added to the polyphthalamide resin, whereby the substrate's volume resistivity is lowered to $10^4$ Ω cm or less.

There is provided in this invention for an organic photoconductor for electrophotography, comprising; a cylindrical substrate composed of polyphthalamide resin as the main component.

There is provided in this invention for an organic photoconductor for electrophotography, comprising; a photoconductive layer, and the photoconductive layer including a charge generation layer and a charge transport layer of a hydrazone compound.

There is provided in this invention for a Method for manufacturing an organic photoconductor comprising the step of forming a cylindrical tubular substrate of polyphthalamide resin.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*b*) is a cross section along X—X of FIG. 1(*a*).

DETAILED DESCRIPTION OF THE PREFERRED EMBODIMENTS

Figure 1A:
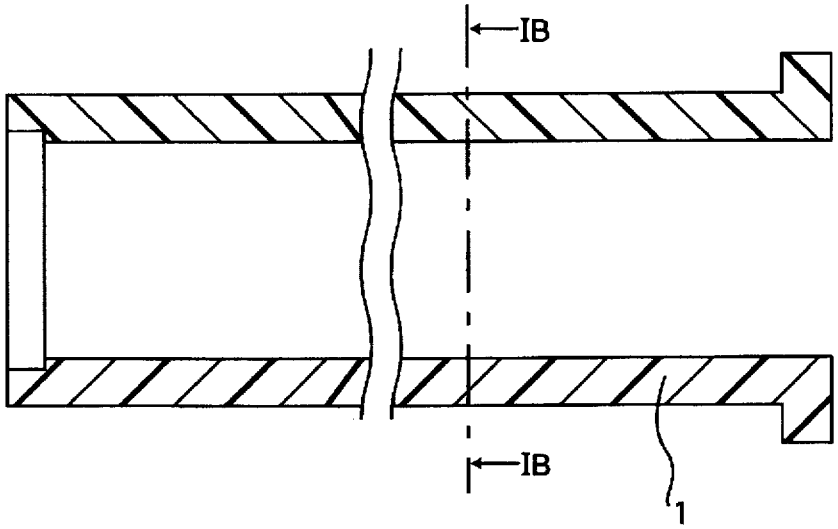
FIG. 1(*a*) is a vertical cross section schematically showing an embodiment of a substrate for electrophotographic photoconductor.

An example of an embodiment of a substrate material of the invention contains polyphthalamide resin, carbon black, dispersing agent for the carbon black, and glass fiber reinforcing agent. Preferably, the resin content is 40 weight parts or more of the total substrate material.

Table 1 compares the chemical resistance and thermal resistance of the polyphthalamide resin example of the present invention with the same properties for a PPS resin substrate. The chemical resistance was evaluated by the mass changing rates (%) after dipping cylindrical molds of the resins in acetone, methylenechloride, and dichloroethane for 24 hr. The thermal resistance was evaluated by the changing rate of the diameter and length (%) of the cylindrical molds after heating at 120 C for 48 hr.

TABLE 1

| Evaluation Items | Polyphthalamide resin | PPS resin |
|---|---|---|
| Chemical Resistance (Mass Changing Rate (%) after 24 hr. of Dipping) | | |
| Acetone | 0 | +0.05 |
| Methylenechloride | +0.05 | 0 |
| Dichloroethane | 0 | 0 |
| Thermal Resistance (Dimensional changing rate (%) after 48 hr. of heating at 120_C.) | | |

TABLE 1-continued

| Evaluation Items | Polyphthalamide resin | PPS resin |
|---|---|---|
| In diameter | −0.02 | −0.01 |
| In length | −0.01 | 0 |

As Table 1 indicates, the polyphthalamide resin and the PPS resin exhibit the similar chemical resistance and thermal resistance. By using the polyphthalamide resin as the main component of the substrate material, thermal deformation and swelling, caused by the solvent of the coating liquid for forming the organic photoconductive layer, are suppressed. Thus, the deformation of the long and thin substrate with small diameter is reduced, and the dimensional precision enough to put the substrate into practical use is obtained.

In place of the standard conductive carbon black that is normally added to the PPS resin, highly conductive carbon black having volume resistivity of $10^{-1}$ Ω cm or less, for example furnace carbon or more highly conductive channel black, is added to the polyphthalamide resin to lower the volume resistivity of the substrate. By the use of the highly conductive carbon black, the amount of the carbon black, necessary to reduce the volume resistivity of the substrate material down to the required value of $10^4$ Ω cm or less, is reduced to 20 weight % or less of the substrate material. The reduced amount of carbon means that the viscosity of the substrate material is lowered to the range preferable for molding a thin and long substrate with small diameter. This preferable range is, for example, from 20 to 50 g/10 min. in melt flow rate (MFR) at 300° C.

Naturally, it is preferable to disperse the carbon black uniformly in the substrate material. Preferably, dispersing agent is added to the substrate material. Though the favorable addition amount of dispersing agent depends on the addition amount of carbon black, the amount commonly used is within the range of from 10 to 30 weight %. The optimal amount of dispersing agent used is that which effects a homogeneous dispersal of the conduction enhancing agent without itself negatively affecting the electric conductivity, mechanical strength, surface roughness and such properties of the substrate.

Surface roughness of the substrate is greatly affected by the grain diameter of the carbon black. By setting the average grain diameter of the carbon black at between 20 and 50 nm, the maximum surface roughness of the substrate may be confined within the range of from 0.5 to 1.2 μm.

Adding a reinforcing agent to the substrate material compensates for the diminished mechanical strength caused by the addition of conductivity enhancing agent, such as carbon black, to the resin. If glass fiber is used as the reinforcing agent, the preferable glass fiber is 20 μm in diameter and 3 mm in length. The preferable addition amount of such glass fiber depends on the addition amount of the carbon black. For example, if 20 weight % carbon black is used, the preferable addition amount of glass fiber would range from 10 to 30 weight %. The optimal amount of reinforcing agent is that which gives an acceptable mechanical strength and dimensional stability without negatively affecting the electric conductivity, surface roughness and such properties of the substrate.

As described in the example above, the substrate material of one embodiment of the invention includes carbon black as a conduction enhancing agent, dispersing agent for the carbon black, and glass fiber as a reinforcing agent in addition to the polyphthalamide resin. By setting the amount of the polyphthalamide resin at 40 weight % or more, the favorable features of the polyphthalamide resin are effectively utilized. In contrast to PPS resin, polyphthalamide resin exhibits excellent compatibility to the organic photoconductive materials. Therefore, excellent adhesion between the substrate and an organic photoconductive layer is realized simply by degreasing the substrate surface. Exposure to ultraviolet radiation, corona discharge, or other such preparative surface activating treatments are un-necessary.

The substrate of the invention is manufactured by injection molding of the material described above. By adopting an appropriate molding die and optimizing the molding conditions, a substrate with the desired shape and surface roughness is manufactured with excellent precision and excellent productivity. In contrast to the aluminum alloy substrate, all machining processes, including the process for roughening the substrate surface, are eliminated from the manufacturing process with the present invention.

Figure 1B:
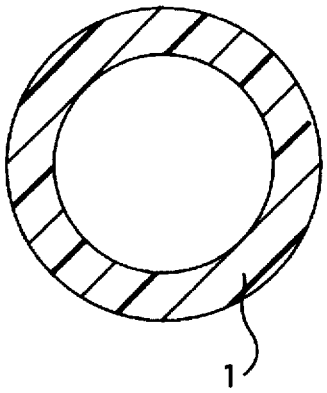
Figure 2:
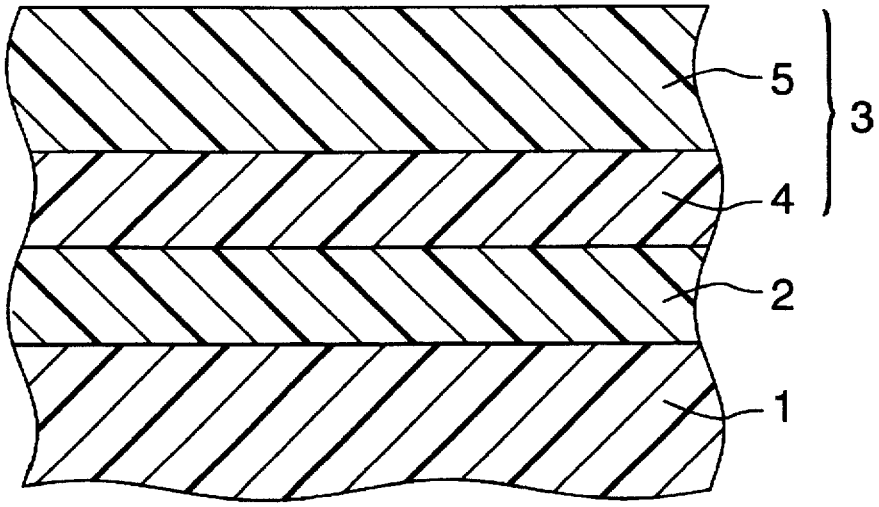
FIG. 2 is a cross section schematically showing a layer structure of an embodiment of a photoconductor for electrophotography according to the invention.

Referring to FIGS. 1(*a*), 1(*b*), and 2, a photoconductive layer 3 is disposed on a substrate 1 with an undercoating layer 2 interposed between substrate 1 and photoconductive layer 3. Photoconductive layer 3 further includes a charge generation layer 4 formed on undercoating layer 2 and a charge transport layer 5 formed on charge generation layer 4. Undercoating layer 2 is formed optionally.

Figure 3:
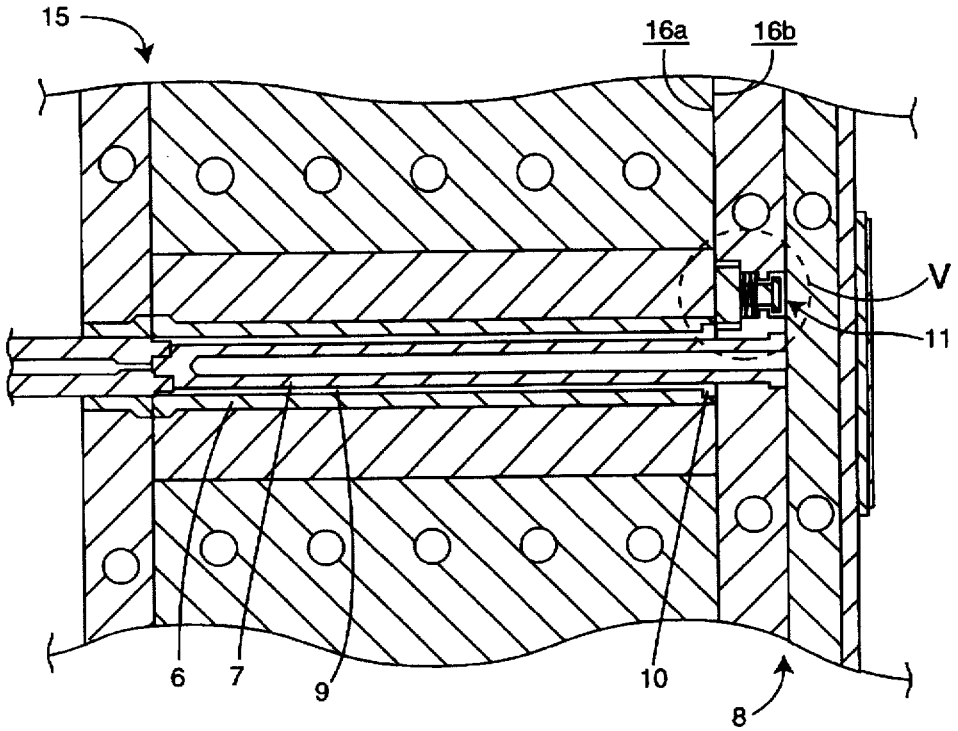
FIG. 3 is a longitudinal cross section showing the closed state of a molding die.
Figure 4:
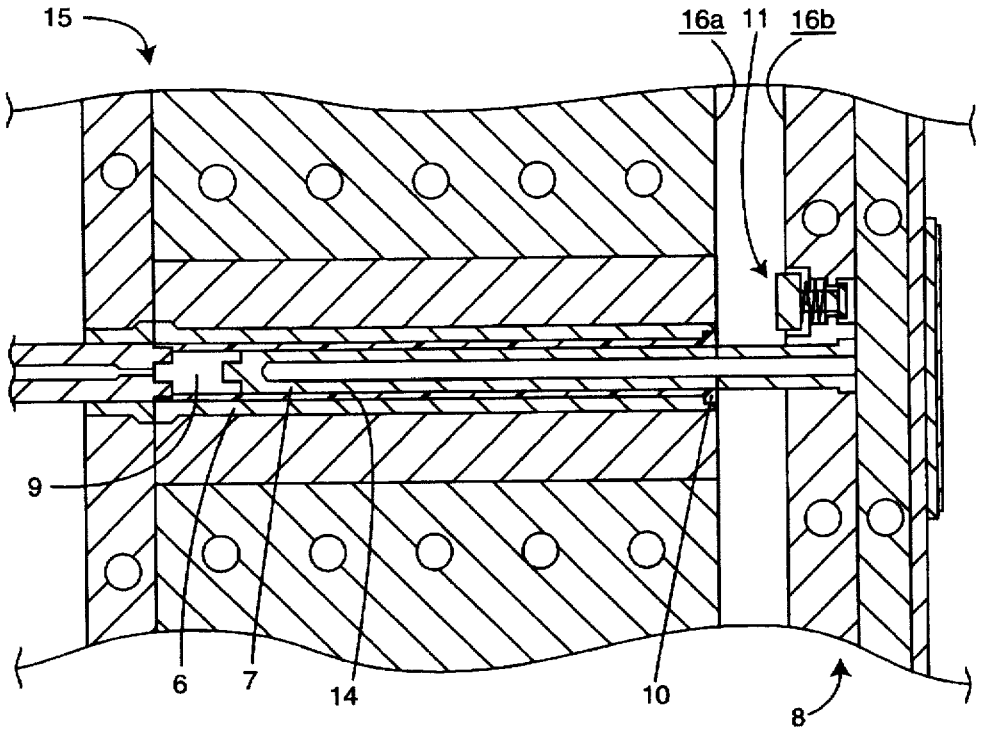
FIG. 4 is a longitudinal cross section showing a molding die in the open state with the cavity die and fixed die separated from each other.
Figure 5:
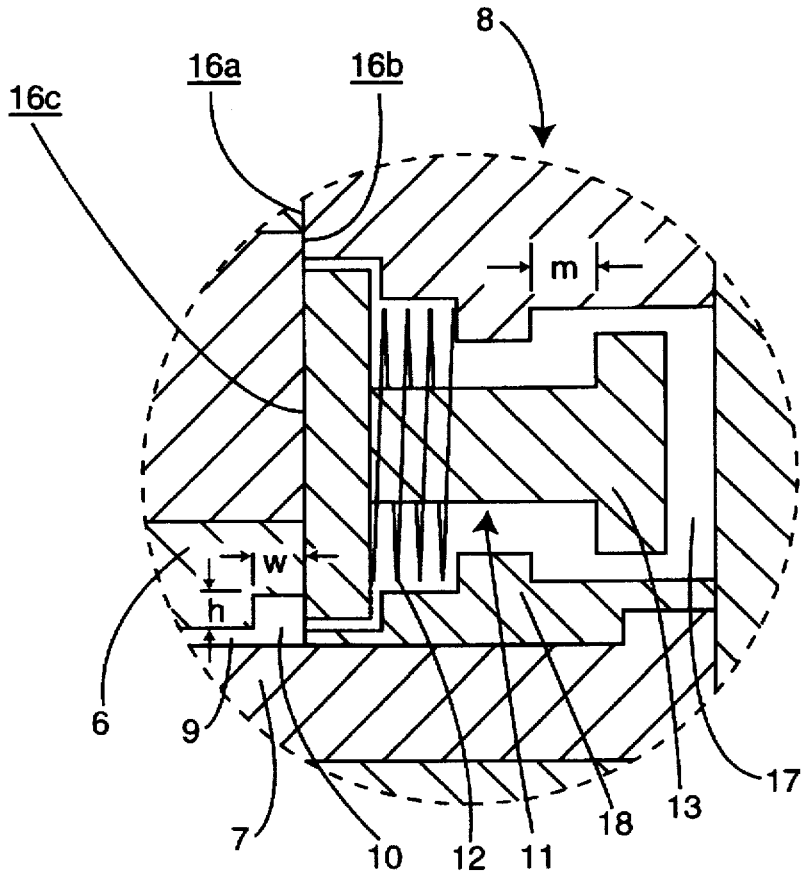
FIG. 5 is an expanded view showing the spring knock of FIG. 3 and its peripheral portion.

Cylindrical substrate 1 is molded in a molding die assembly 15 as shown in FIGS. 3, 4 and 5. FIG. 3 illustrates a closed state of molding die assembly 15 prior to injection of resin. In this configuration molding die assembly 15 has its cavity die 6 and a fixed die 8 contacting tightly at their respective end faces 16*b* and 16*a*. A core die 7 is inserted into a cavity 9 of cavity die 6 to form a space that is complementary to the shape and dimensions required to form cylindrical substrate 1.

FIG. 4 shows a partially open state of molding die 15 in which cavity die 6 and fixed die 8 are separated from each other. Reference numeral 14 designates a resin, shown here molded in the shape of cylindrical substrate 1, ready for removal. Core die 7 being attached to fixed die 8 withdraws from its position within cavity die 6 as cavity die 6 and fixed die 8 separate. Resin 14 is removed from cavity die 6 secondarily to the withdrawal of core die 7.

Referring now to FIG. 5, an expanded view of an encircled area V of FIG. 3, a spring knock 11 and its peripheral environment are shown in the closed configuration with end face 16*a* of fixed die 8 contacting end face 16*b* of cavity die 6. An end face 16*c* of a knockout pin 13, captured within a stepped cavity 17 by a capture spline 18, is held in contact with end face 16*b* under the force of a spring 12 acting to eject knockout pin 13 from fixed die 8.

Capture spline 18 forms both the contact surface whereby spring 12 contacts fixed die 8 as well as the retaining surface that knockout pin 13 contacts when spring 12 begins to eject knockout pin 13 from stepped cavity 17 as cavity die 6 begins to separate from fixed die 8. Knockout pin 13 can only be ejected from stepped cavity 17 a distance of "m" before it contacts capture spline 18 and the ejection movement is arrested. With molding die assembly 15 in the closed state, although most of end face 16*c* contacts end face 16*b*, a small segment of end face 16*c* overlaps cavity 9.

Referring again to FIGS. 3, 4, and 5; in the manufacturing process, uncured resin 14 is loaded at a step portion 10 by a side gate scheme into closed molding die 15. Once resin 14 is cured, molding die 15 is opened and cured resin 14 is removed. Cured resin 14, now in the shape of cylindrical substrate 1 of FIGS. 1A and 1b, easily separates from core die 7 and fixed die 8 because of the action of spring knock 11.

When spring 12, which has been compressed during the closed state of molding die assembly 15, as shown in FIGS. 3 and 5, is released as molding die assembly 15 opens as shown in FIG. 4, end face 16c of knockout pin 13 protrudes from end face 16a of fixed die 8 remaining in contact with end face 16b and cured resin 14. This action causes cured resin 14 to remain aligned in cavity die 6 and continues until end face 16c of knockout pin 13 protrudes from fixed die 8 a length of "m" described in FIG. 5.

Therefore, cavity die 6 moves with cured resin 14 held therein, and cured resin 14 leaves core die 7 behind and remains in cavity die 6 after molding die assembly 15 is opened. Since core die 7 is tapered and the surface of core die 7 is smooth, core die 7 smoothly disengages cured resin 14. As cured resin 14 disengages core die 7, cured resin 14 uniformly shrinks radially, to facilitate removal from cavity die 6 without damaging either cured resin 14 or the surface of cavity die 6.

In a comparison of Polyphthalamide resin and PPS resin, substrates No. 1-1 and No. 1-2, listed in Table 3, were fabricated under the same conditions from materials 1-1 and 1-2, listed in Table 2, in molding die assembly 15, shown in FIGS. 3, 4 and 5.

Substrates 1-1 and 1-2 are 30 mm in outer diameter, 260.5 mm in length, and have an inner diameter of 28.5 mm at the thinner end, and 26.5 mm at the thicker end. In other words, the inner surface of each substrate is uniformly tapered over its length, with respect to the distance from the axis of rotation.

TABLE 2

| Material | Name of Provider & Material | Contents (weight %) No. 1-1 | No. 1-2 |
|---|---|---|---|
| Poly-phthalamide resin | Amodel, A-1240L (M.P. 315° C., Thermal Deformation Temp.: 280° C.) | 60 | |
| PPS resin | | | 50 |
| Carbon black | Cabot Furnace Carbon XC72 (Grain Diameter 30 nm) | 15 | |
| | Cabot Furnace Carbon BP-480 (Grain Diameter 30 nm) | | 20 |
| Clay | Tsuchiya Kaolin SATINTIONES | 10 | 15 |
| Glass fiber | Nippon Sheet Glass Co., Ltd. RES 03-TP76 (Diameter: 20, μm, Length: 3 mm) | 15 | 15 |

TABLE 3

| Substrate No. | 1-1 | 1-2 |
|---|---|---|
| Substrate Material | 1-1 | 1-2 |
| Cylinder Temp. (°C.) | | |
| Rear Part | 290 | 280 |
| Middle Part | 320 | 290 |
| Front Part | 340 | 300 |
| Nozzle Temp. (°C.) | 340 | 310 |
| Die Temp. (°C.) | 150 | 150 |
| Injection Pressure ($\times 10^8$ N/m$^2$) | 1.62 | 1.62 |
| Loading Time (sec) | 0.1 | 0.1 |
| Cooling Time (sec) | 30 | 30 |

Photoconductors were then fabricated on each of the substrates under the same conditions as follows. Undercoating liquid was prepared by dissolving 5 weight parts of alcohol-soluble polyamide resin (Amilan CM8000, TORAY INDUSTRIES, INC.) into 95 weight parts of methanol. Undercoating liquid was coated onto the substrate and dried at 120° C. for 15 min. to form an undercoating layer having a thickness of 0.5 μm.

Coating liquid for the charge generation layer were prepared by dispersing in a mixer 10 weight parts of metal-free phthalocyanine (FASTGEN BLUE 8120, DAINIPPON INK & CHEMICALS, INC.) and 10 weight parts of vinyl chloride resin (MR-110, NIPPON ZEON CO., LTD.) into a mixed solvent of 686 weight parts of dichloromethane and 294 weight parts of 1,2-dichloroethane for one hour, followed by further dispersing the dispersoids in an ultrasonic mixer for 30 min. A charge generation layer was formed to be 0.5 μm in thickness after drying the coating liquid, coated on the undercoating layer, at 80° C. for 30 min.

Figure 6:
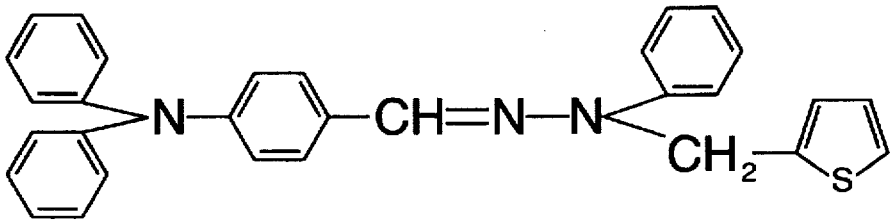
FIG. 6 shows the structural formula of the hydrazone compound used as a charge transport agent in the invention.

Coating liquid for the charge transport layer was prepared by dissolving 100 weight parts of a hydrazone compound whose structural formula is described in FIG. 6 (prepared at FUJI ELECTRIC CO., LTD.) and 100 weight parts of polycarbonate resin (U-pilon PCZ, MITSUBISHI GAS CHEMICAL CO., LTD.) into 800 weight parts of dichloromethane. The coating liquid was coated onto the charge generation layer, and dried at 90° C. for one hour such that a charge transport layer with a thickness of 20 μm was formed.

The photoconductors fabricated as described above were evaluated, and the results are given in Table 4.

TABLE 4

| Photoconductor No. | 1-1 | 1-2 |
|---|---|---|
| Substrate Material | 1-1 | 1-2 |
| MFR (g/10 min.) | 30 | 40 |
| Volume Resistivity (Ω cm) | $2 \times 10^3$ | $3 \times 10^2$ |
| Ease of Injection Molding | Good | Good |
| Mechanical Strength ($\times 10^8$/m$^2$) | 1.0 | 0.78 |
| Chemical Resistance (%) | +0.5 | +0.5 |
| Surface Roughness Rmax (μm) | 0.9 | 0.8 |
| Precision of Outer Diameter (±mm) | 0.05 | 0.05 |
| Changing Rate of Dimensions (%) | +0.05 | −0.7 |
| $V_{K5}$ (%) | 91 | 92 |
| $V_R$ (V) | 32 | 35 |
| Printing Performance | Good | Good |
| Adhesion between Substrate and Photoconductive Layer (Cross-cut Adhesion Test) | Good | Peeling |

The evaluation items include: melt flow rate (MFR) at 300° C., volume resistivity, ease of use for injection molding, mechanical strength, and chemical resistance (mass changing rate after dipping in methylene chloride for 2 hr). The evaluation items also include surface roughness (Rmax), precision of the outer diameter, and changing rate of the dimensions after heating at 120° C. for 48 hr. of the substrates. As for the photoconductors, potential retention rate ($V_{K5}$) after 5 sec of charging in the dark, residual potential ($V_R$) after exposing the photoconductors to a monochromatic light of 780 nm at 10 μJ/cm$^2$, and printing performance when installed in a commercial semiconductor laser printer. Lastly, the adhesion between the substrate and the photoconductive layer was evaluated by the cross-cut adhesion test as described in The Handbook of Japanese Industrial Standards, pages 280–281, K5400 8.5.1, which is incorporated herein by reference.

As described in Table 4, substrate 1-2, made of the material 1-2, which contains PPS resin as the main component, exhibits the equivalent chemical resistance to that of substrate 1-1, made of the material 1-1 which contains polyphthalamide resin. In contrast, substrate 1-2 is inferior to substrate 1-1 in adhesiveness between the substrate and the photoconductive layer and in mechanical strength.

Cylindrical tubular substrates of this invention, and organic photoconductors for electrophotography using the cylindrical tubular substrates of this invention, show the following characteristics. The substrate is made of polyphthalamide resin combined with carbon black to lower the volume resistivity below $10^4$ Ω cm or less. As a result, the substrate is light in weight, highly conductive electrically, highly resistant chemically and thermally, and adheres readily to the photoconductive layer. Due to these favorable properties, it is not necessary to apply ultraviolet light irradiation or such surface treatment to improve the adhesion between the substrate and the photoconductive layer. The substrate of the invention has excellent dimensional stability and is highly resistant to oxidation in air or other such deformation even without application of additional surface treatment. These favorable properties of the substrate results in production of an electrophotographic photoconductor that is also light in weight, strong, and mechanically stable.

By limiting the average grain diameter of the carbon black, mixed with the substrate material, to within the range of 20 to 50 nm, the surface roughness (Rmax) of the substrate is favorably uniform within the range of 0.5 to 1.2 μm. Adding a dispersing agent to the carbon black/resin mixture, increases uniformity of the mixture and adds an additional increment of surface roughness uniformity.

By adding glass fiber to the substrate material, the mechanical strength of the substrate is improved and the cylindrical substrate resists deformation even when the substrate is long and thin. Glass fibers of 20 μm in diameter and 3 mm in length are favored, since this size glass fiber has little impact on the surface roughness of the substrate. Additional ingredients do not impact the desirable properties of the substrate as long as the substrate material contains at least 40 weight % polyphthalamide resin.

As explained above, cylindrical substrates of polyphthalamide resin as the main component are manufactured with excellent productivity by injection molding. The use of carbon black with exceptionally low volume resistivity of $10^{-1}$ Ω cm allows the lowering the volume resistivity of the final substrate material to below $10^4$ Ω cm without increasing viscosity of the raw resin above a practical level usable viscosity in the injection molding process. In this regard, substrate material, in which the average grain diameter size of the carbon black is from 20 to 50 nm, and substrate material to which glass fiber is added, do not negatively impact injection molding productivity.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A cylindrical tubular substrate for electrophotography comprising:

polyphthalamide resin as the main component thereof.

2. A cylindrical tubular substrate for electrophotography comprising:

polyphthalamide resin as the main component thereof; and carbon black added to said polyphthalamide resin, such that said substrate's volume resistivity is lowered to $10^4$ Ω cm or less.

3. The cylindrical tubular substrate according to claim 2, wherein said carbon black's average grain diameter is from 20 to 50 nm.

4. The cylindrical tubular substrate according to claim 2, further comprising a dispersing agent for dispersing said carbon black.

5. The cylindrical tubular substrate according to claim 4, wherein said dispersing agent comprises inorganic powder, said inorganic powder's average grain diameter being 50 μm or less.

6. The cylindrical tubular substrate according to claim 2, further comprising glass fiber as a reinforcing agent.

7. The cylindrical tubular substrate according to claim 2, wherein said polyphthalamide resin's content is 40 weight % or more of said substrate.

8. The cylindrical tubular substrate according to claim 2, wherein said substrate is 3 mm or less in thickness.

9. An organic photoconductor for electrophotography comprising:

a cylindrical tubular substrate for electrophotography having polyphthalamide resin as the main component thereof; and an organic photoconductive layer formed on said cylindrical tubular substrate.

10. An organic photoconductor for electrophotography, comprising:

a cylindrical tubular substrate for electrophotography having polyphthalamide resin as the main component thereof;

carbon black added to said polyphthalamide resin, such that said substrate's volume resistivity is lowered to $10^4$ Ω cm or less; and an organic photoconductive layer formed on said cylindrical tubular substrate.

11. An organic photoconductor for electrophotography, comprising:

a cylindrical substrate composed of polyphthalamide resin as the main component.

12. The organic photoconductor of claim 11, wherein said cylindrical substrate includes a conductivity enhancing agent.

13. The organic photoconductor of claim 12, wherein said conductivity enhancing agent is dispersed in said polyphthalamide resin by a dispersing agent.

14. The organic photoconductor of claim 12, wherein said cylindrical substrate further includes a reinforcing agent.

15. The organic photoconductor of claim 12, wherein said conductivity enhancing agent is a carbon black.

16. The organic photoconductor of claim 15, wherein said carbon black has a volume resistivity of less than 1 Ω cm.

17. The organic photoconductor of claim 15, wherein said carbon black has a volume resistivity of about 0.1 Ω cm.

18. The organic photoconductor of claim 15, wherein a concentration of said carbon black is less than 20 weight %.

19. The organic photoconductor of claim 16, wherein a concentration of said carbon black is less than 20 weight %.

20. The organic photoconductor of claim 17, wherein a concentration of said carbon black is less than 20 weight %.

21. The organic photoconductor of claim 18, wherein said carbon black has an average grain diameter within the range of 20–50 nm.

22. The organic photoconductor of claim 19, wherein said carbon black has an average grain diameter within the range of 20–50 nm.

23. The organic photoconductor of claim 20, wherein said carbon black has an average grain diameter within the range of 20–50 nm.

24. The organic photoconductor of claim 13, wherein a concentration of said dispersing agent is in the range of 10–30 weight %.

25. The organic photoconductor of claim 13, wherein said dispersing agent is at least one selected from the group consisting of Magnesium sulfide, talc, potassium titanate, potassium silicate, potassium carbonate, and clay.

26. The organic photoconductor of claim 25, wherein a concentration of said dispersing agent is in the range of 10–30 weight %.

27. The organic photoconductor of claim 14, wherein said reinforcing agent is at least one selected from the group consisting of glass fibers, carbon fibers, and Kevlar™ fibers.

28. The organic photoconductor of claim wherein said reinforcing agent is glass fibers.

29. The organic photoconductor of claim 27, wherein a concentration of said reinforcing agent is in a range of 10–30 weight %.

30. The organic photoconductor of claim 28, wherein a concentration of said reinforcing agent is in a range of 10–30 weight %.

31. The organic photoconductor of claim 13, wherein said cylindrical substrate further includes a reinforcing agent.

32. The organic photoconductor of claim 14, wherein said conductivity enhancing agent is a carbon black.

33. The organic photoconductor of claim 32, wherein said carbon black has a volume resistivity of less than 1 Ω cm.

34. The organic photoconductor of claim 32, wherein said carbon black has a volume resistivity of about 0.1 Ω cm.

35. The organic photoconductor of claim 32, wherein a concentration of said carbon black is less than 20 weight %.

36. The organic photoconductor of claim 33, wherein a concentration of said carbon black is less than 20 weight %.

37. The organic photoconductor of claim 34, wherein a concentration of said carbon black is less than 20 weight %.

38. The organic photoconductor of claim 35, wherein said carbon black has an average grain diameter within the range of 20–50 nm.

39. The organic photoconductor of claim 36, wherein said carbon black has an average grain diameter within the range of 20–50 nm.

40. The organic photoconductor of claim 37, wherein said carbon black has an average grain diameter within the range of 20–50 nm.

41. The organic photoconductor of claim 31, wherein a concentration of said dispersing agent is in the range of 10–30 weight %.

42. The organic photoconductor of claim 31, wherein said dispersing agent is at least one selected from the group consisting of Magnesium sulfide, talc, potassium titanate, potassium silicate, potassium/carbonate, and clay.

43. The organic photoconductor of claim 42, wherein a concentration of said dispersing agent is in the range of 10–30 weight %.

44. The organic photoconductor of claim 31, wherein said reinforcing agent is at least one selected from the group consisting of glass fibers, carbon fibers, and Kevlar™ fibers.

45. The organic photoconductor of claim 31, wherein said reinforcing agent is glass fibers.

46. The organic photoconductor of claim 44, wherein a concentration of said reinforcing agent is in a range of 10–30 weight %.

47. The organic photoconductor of claim 45, wherein a concentration of said reinforcing agent is in a range of 10–30 weight %.

48. An organic photoconductor for electrophotography, comprising:

a photoconductive layer; and said photoconductive layer including a charge transport layer of a hydrozone compound.

49. The organic photoconductor of claim 48, further comprising an undercoating layer disposed beneath said photoconductive layer.

50. The organic photoconductor of claim 48, further comprising a cylindrical tubular substrate disposed beneath said photoconductive layer.

51. The organic photoconductor of claim 49, further comprising a cylindrical tubular substrate disposed beneath said undercoating layer.

52. The organic photoconductor of claim 50, wherein said cylindrical tubular substrate is composed of an aromatic polyamide resin.

53. The organic photoconductor of claim 52, wherein said aromatic polyamide resin is polyphthalamide resin.

54. The organic photoconductor of claim 51, wherein said cylindrical tubular substrate is composed of an aromatic polyamide resin.

55. The organic photoconductor of claim 54, wherein said aromatic polyamide resin is polyphthalamide resin.

56. The organic photoconductor of claim 52, wherein said cylindrical substrate includes a conductivity enhancing agent.

57. The organic photoconductor of claim 56, wherein said conductivity enhancing agent is dispersed in said polyphthalamide resin by a dispersing agent.

58. The organic photoconductor of claim 56, wherein said cylindrical substrate further includes a reinforcing agent.

59. The organic photoconductor of claim 56, wherein said conductivity enhancing agent is a carbon black.

60. The organic photoconductor of claim 59, wherein said carbon black has a volume resistivity of less than 1 Ω cm.

61. The organic photoconductor of claim 59, wherein said carbon black has a volume resistivity of about 0.1 Ω cm.

62. The organic photoconductor of claim 59, wherein a concentration of said carbon black is less than 20 weight %.

63. The organic photoconductor of claim 60, wherein a concentration of said carbon black is less than 20 weight %.

64. The organic photoconductor of claim 61, wherein a concentration of said carbon black is less than 20 weight %.

65. The organic photoconductor of claim 62, wherein said carbon black has an average grain diameter within the range of 20–50 nm.

66. The organic photoconductor of claim 63, wherein said carbon black has an average grain diameter within the range of 20–50 nm.

67. The organic photoconductor of claim 64, wherein said carbon black has an average grain diameter within the range of 20–50 nm.

68. The organic photoconductor of claim 57, wherein a concentration of said dispersing agent is in the range of 10–30 weight %.

69. The organic photoconductor of claim 57, wherein said dispersing agent is at least one selected from the group consisting of Magnesium sulfide, talc, potassium titanate, potassium silicate, potassium carbonate, and clay.

70. The organic photoconductor of claim 69, wherein a concentration of said dispersing agent is in the range of 10–30 weight %.

71. The organic photoconductor of claim 58, wherein said reinforcing agent is at least one selected from the group consisting of glass fibers, carbon fibers, and Kevlar™ fibers.

72. The organic photoconductor of claim 58, wherein said reinforcing agent is glass fibers.

73. The organic photoconductor of claim 71, wherein a concentration of said reinforcing agent is in a range of 10–30 weight %.

74. The organic photoconductor of claim 72, wherein a concentration of said reinforcing agent is in a range of 10–30 weight %.

75. The organic photoconductor of claim 54, wherein said cylindrical substrate includes a conductivity enhancing agent.

76. The organic photoconductor of claim 75, wherein said conductivity enhancing agent is dispersed in said polyphthalamide resin by a dispersing agent.

77. The organic photoconductor of claim 75, wherein said cylindrical substrate further includes a reinforcing agent.

78. The organic photoconductor of claim 75, wherein said conductivity enhancing agent is a carbon black.

79. The organic photoconductor of claim 78, wherein said carbon black has a volume resistivity of less than 1 Ω cm.

80. The organic photoconductor of claim 78, wherein said carbon black has a volume resistivity of about 0.1 Ω cm.

81. The organic photoconductor of claim 78, wherein a concentration of said carbon black is less than 20 weight %.

82. The organic photoconductor of claim 79, wherein a concentration of said carbon black is less than 20 weight %.

83. The organic photoconductor of claim 80, wherein a concentration of said carbon black is less than 20 weight %.

84. The organic photoconductor of claim 81, wherein said carbon black has an average grain diameter within the range of 20–50 ηm.

85. The organic photoconductor of claim 82, wherein said carbon black has an average grain diameter within the range of 20–50 ηm.

86. The organic photoconductor of claim 83, wherein said carbon black has an average grain diameter within the range of 20–50 ηm.

87. The organic photoconductor of claim 76, wherein a concentration of said dispersing agent is in the range of 10–30 weight %.

88. The organic photoconductor of claim 76, wherein said dispersing agent is at least one selected from the group consisting of Magnesium sulfide, talc, potassium titanate, potassium silicate, potassium carbonate, and clay.

89. The organic photoconductor of claim 88, wherein a concentration of said dispersing agent is in the range of 10–30 weight %.

90. The organic photoconductor of claim 77, wherein said reinforcing agent is at least one selected from the group consisting of glass fibers, carbon fibers, and Kevlar™ fibers.

91. The organic photoconductor of claim 77, wherein said reinforcing agent is glass fibers.

92. The organic photoconductor of claim 90, wherein a concentration of said reinforcing agent is in a range of 10–30 weight %.

93. The organic photoconductor of claim 91, wherein a concentration of said reinforcing agent is in a range of 10–30 weight %.

94. A Method for manufacturing an organic photoconductor comprising the step of forming a cylindrical tubular substrate of polyphthalamide resin.

* * * * *

UNITED STATES PATENT AND TRADEMARK OFFICE

CERTIFICATE OF CORRECTION

PATENT NO. : 5,712,067

DATED : January 27, 1998

INVENTOR(S) : Noriaki KAWATA

It is certified that an error appears in the above-identified patent and that said Letters Patent is hereby corrected as shown below:

Claim 28, line 1, after "claim" insert --14--.

Signed and Sealed this

Fifth Day of December, 2000

*Attest:*

Q. TODD DICKINSON

*Attesting Officer*

*Director of Patents and Trademarks*